US011306926B2

(12) United States Patent
Watanabe et al.

(10) Patent No.: US 11,306,926 B2
(45) Date of Patent: Apr. 19, 2022

(54) OUTDOOR UNIT OF AIR-CONDITIONING APPARATUS

(71) Applicant: Mitsubishi Electric Corporation, Tokyo (JP)

(72) Inventors: Takahiro Watanabe, Tokyo (JP); Kazuho Ito, Tokyo (JP); Tomoya Yanase, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 284 days.

(21) Appl. No.: 16/616,614

(22) PCT Filed: Jul. 26, 2017

(86) PCT No.: PCT/JP2017/027074
§ 371 (c)(1),
(2) Date: Nov. 25, 2019

(87) PCT Pub. No.: WO2019/021395
PCT Pub. Date: Jan. 31, 2019

(65) Prior Publication Data

US 2020/0182492 A1 Jun. 11, 2020

(51) Int. Cl.
*F24F 1/16* (2011.01)
*F24F 1/22* (2011.01)
(Continued)

(52) U.S. Cl.
CPC ..... *F24F 1/46* (2013.01); *F24F 1/22* (2013.01); *F24F 1/16* (2013.01); *F24F 1/56* (2013.01);
(Continued)

(58) Field of Classification Search
CPC ..... F24F 1/16; F24F 1/22; F24F 1/46; F24F 1/56; F24F 11/89; F24F 13/20; F24F 2013/202; F24F 2013/207
See application file for complete search history.

(56) References Cited

FOREIGN PATENT DOCUMENTS

JP H07-012394 A 1/1995
JP H11-248199 A 9/1999
(Continued)

OTHER PUBLICATIONS

International Search Report of the International Searching Authority dated Sep. 5, 2017 for the corresponding international application No. PCT/JP2017/027074 (and English translation).

*Primary Examiner* — Larry L Furdge
*Assistant Examiner* — Chang H Park
(74) *Attorney, Agent, or Firm* — Posz Law Group, PLC

(57) ABSTRACT

An outdoor unit of an air-conditioning apparatus includes a housing forming an outline of the outdoor unit, a partition plate extending from a front surface toward a rear surface of the housing and partitioning an interior of the housing into an air-sending device chamber and a machine chamber, a heat exchanger disposed in the air-sending device chamber and along an end portion located at the rear surface of the housing, and a holder mounted on the heat exchanger and accommodating a temperature-measurement unit that measures an outside air temperature. The partition plate includes a first flat portion disposed with a space between a rear surface of the first flat portion and the heat exchanger and extending in a longitudinal direction of the heat exchanger, and a second flat portion projecting from a side edge portion of the first flat portion toward the heat exchanger.

3 Claims, 13 Drawing Sheets

(51) Int. Cl.

| | |
|---|---|
| ***F24F 1/46*** | (2011.01) |
| ***F24F 1/56*** | (2011.01) |
| ***F24F 13/20*** | (2006.01) |

(52) U.S. Cl.
CPC ..... *F24F 13/20* (2013.01); *F24F 2013/202* (2013.01); *F24F 2013/207* (2013.01)

(56) References Cited

FOREIGN PATENT DOCUMENTS

| | | | | |
|---|---|---|---|---|
| JP | 2006220361 | A | * | 8/2006 |
| JP | 2007-147205 | A | | 6/2007 |
| JP | 2007147205 | A | * | 6/2007 |
| JP | 2009174760 | A | * | 8/2009 |
| JP | 2014047996 | A | * | 3/2014 |
| JP | 2017083095 | A | * | 5/2017 |

* cited by examiner

OUTDOOR UNIT OF AIR-CONDITIONING APPARATUS

CROSS REFERENCE TO RELATED APPLICATION

This application is a U.S. national stage application of PCT/JP2017/027074 filed on Jul. 26, 2017, the contents of which are incorporated herein by reference.

TECHNICAL FIELD

The present invention relates to an outdoor unit of an air-conditioning apparatus provided with a holder that accommodates a temperature-measurement unit that measures the outside air temperature.

BACKGROUND ART

There is known some outdoor unit of an air-conditioning apparatus provided with a holder that accommodates a temperature-measurement unit that measures the outside air temperature. For example, Patent Literature 1 discloses a holder mounted onto a heat exchanger that has a single-row structure or a multi-row structure and that is disposed inside a housing that forms an outline of an outdoor unit and the holder extends along an end portion at the rear surface of the housing. This holder includes a main body portion that accommodates a thermistor that is the temperature-measurement unit and a cover portion that is pivotally hinged to the main body portion. The main body portion includes a hook unit that engages the heat exchanger by sandwiching an upper end portion of the heat exchanger in a front-rear direction.

CITATION LIST

Patent Literature

Patent Literature 1: Japanese Unexamined Patent Application Publication No. 2007-147205

SUMMARY OF INVENTION

Technical Problem

In a configuration, such as the configuration of the holder disclosed in Patent Literature 1, in which a hook unit engages a heat exchanger by sandwiching an upper end portion of the heat exchanger in the front-rear direction, the dimensions of the hook unit are specified in accordance with the width dimension of the heat exchanger, and thus, the hook unit cannot be mounted on a heat exchanger having a different width dimension. In other words, in some outdoor units of air-conditioning apparatuses, for example, a holder used for an outdoor unit of an air-conditioning apparatus that includes a heat exchanger having a two-row structure cannot be applied to another outdoor unit of an air-conditioning apparatus that includes a heat exchanger having a single-row structure, and consequently, it is necessary to manufacture a holder for each outdoor unit in such a manner that the dimensions of the holder correspond to the width dimension of a heat exchanger included in the outdoor unit. Thus, for some outdoor units of air-conditioning apparatuses, it is necessary to prepare a manufacturing mold for each holder shape, and the manufacturing costs may increase. In addition, it is burdensome to manage different types of holders by classifying the holders by their types, and this management operation is a heavy burden for an operator.

The present invention has been made to solve such problems described above, and it is an object of the present invention to provide an outdoor unit of an air-conditioning apparatus capable of using a holder that is the same as a holder used for another outdoor unit that includes a heat exchanger having a width dimension different from the width dimension of a heat exchanger included in the outdoor unit.

Solution to Problem

An outdoor unit of an air-conditioning apparatus according to an embodiment of the present invention includes a housing forming an outline of the outdoor unit, a partition plate extending from a front surface of the housing toward a rear surface of the housing and partitioning an interior of the housing into an air-sending device chamber and a machine chamber, a heat exchanger disposed in the air-sending device chamber and along an end portion located at the rear surface of the housing, and a holder mounted on the heat exchanger and accommodating a temperature-measurement unit configured to measure an outside air temperature. The partition plate includes a first flat portion disposed with a space between a rear surface of the first flat portion and the heat exchanger and extending in a longitudinal direction of the heat exchanger, and a second flat portion projecting from a side edge portion of the first flat portion toward the heat exchanger. The holder includes an accommodating unit holding the temperature-measurement unit, and a hook unit formed continuous with the accommodating unit, the hook unit extending across a top surface of the heat exchanger and being hooked to the first flat portion.

Advantageous Effects of Invention

According to an embodiment of the present invention, a partition plate may be formed through adjusting the length of a second flat portion, so that the space between a first flat portion and a heat exchanger can fit the shape of a holder, and thus, an outdoor unit can use a holder the same as a holder that is used for another outdoor unit including a heat exchanger whose width dimension is different from the width dimension of a heat exchanger included in the outdoor unit.

DESCRIPTION OF EMBODIMENT

Figure 1:
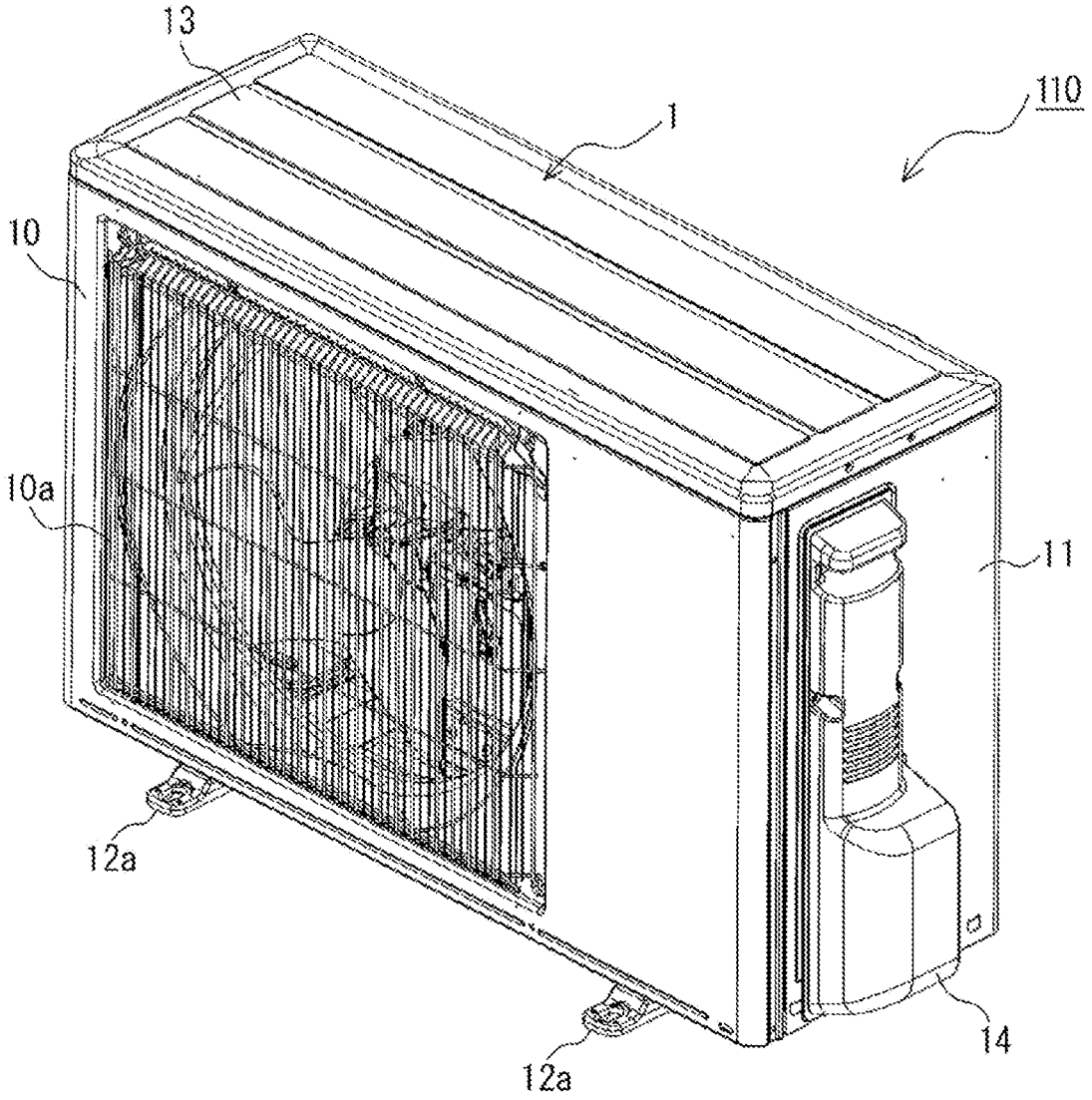
FIG. 1 is a perspective view illustrating an outdoor unit of an air-conditioning apparatus and the outdoor unit is viewed from the front.

An embodiment of the present invention will be described below with reference to the drawings. Note that, in the drawings, portions that are the same as each other or that correspond to each other are denoted by the same reference sign, and descriptions of the portions will be suitably omitted or simplified. In addition, shape, size, arrangement, and other characteristics in the configurations illustrated in the drawings can be suitably changed within the scope of the present invention.

Embodiment

An outdoor unit of an air-conditioning apparatus according to the embodiment of the present invention is configured to be capable of using a holder the same as the holder of a temperature-measurement unit that is used for another outdoor unit including a heat exchanger whose width dimension is different from the width dimension of a heat exchanger included in the outdoor unit according to the present embodiment. For this reason, in the present embodiment, a case will be described as an example in which a holder that is the same as the holder used for an outdoor unit 110 of an air-conditioning apparatus that includes a heat exchanger having a two-row structure is used for an outdoor unit 100 of an air-conditioning apparatus that includes a heat exchanger having a single-row structure.

Figure 2:
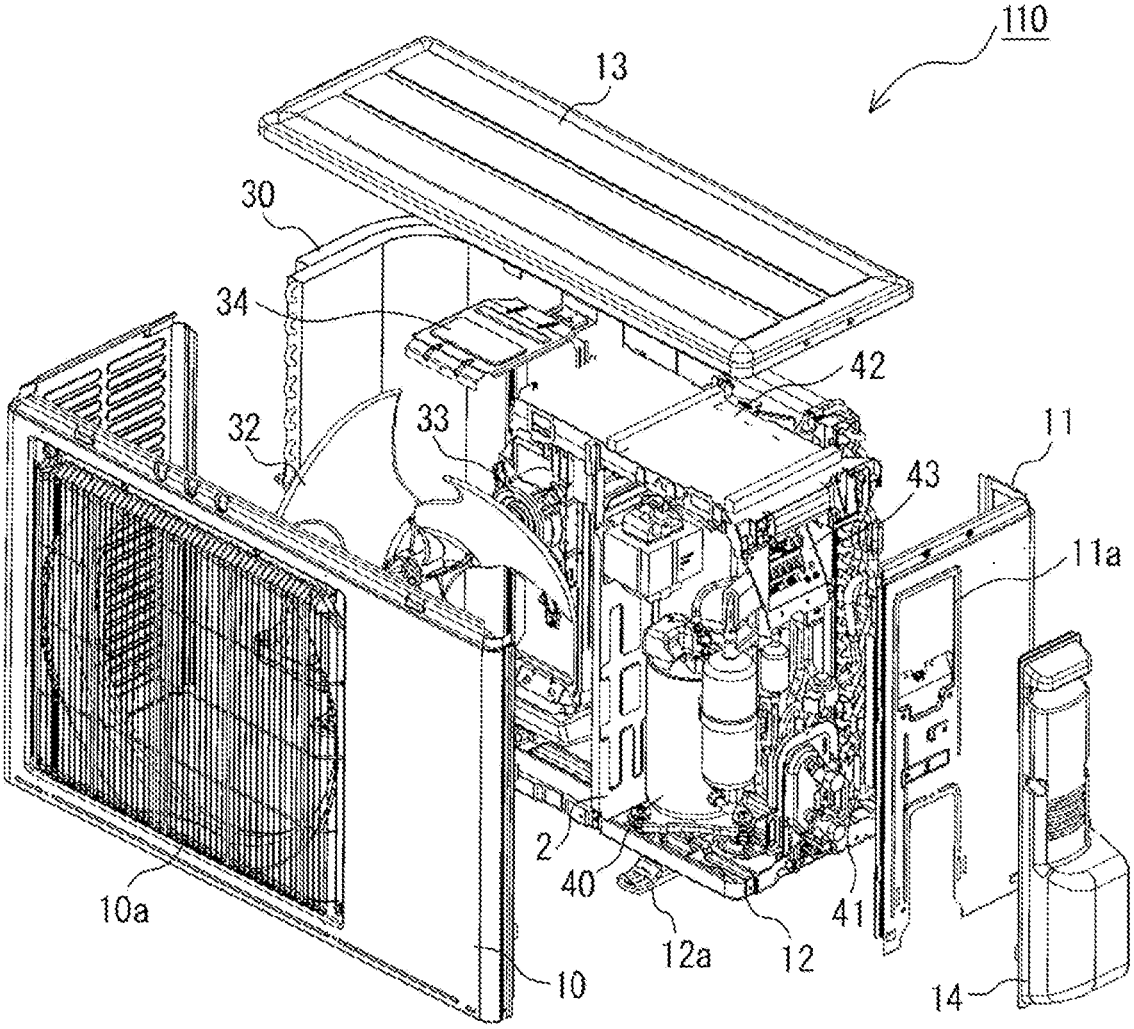
FIG. 2 is an exploded perspective view illustrating the outdoor unit of an air-conditioning apparatus and the outdoor unit is viewed from the front.
Figure 3:
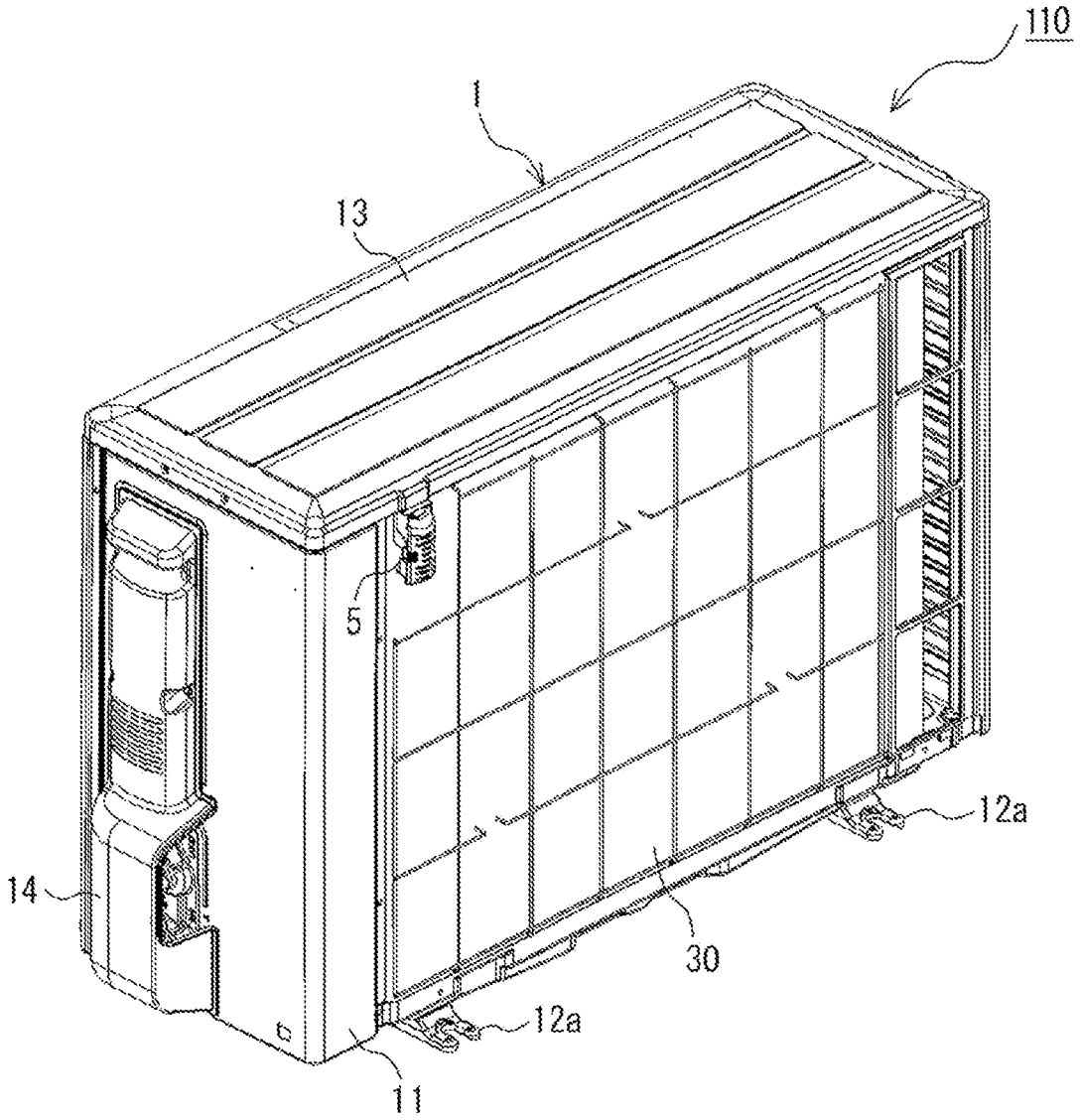
FIG. 3 is a perspective view illustrating the outdoor unit of an air-conditioning apparatus and the outdoor unit is viewed from the rear.
Figure 4:
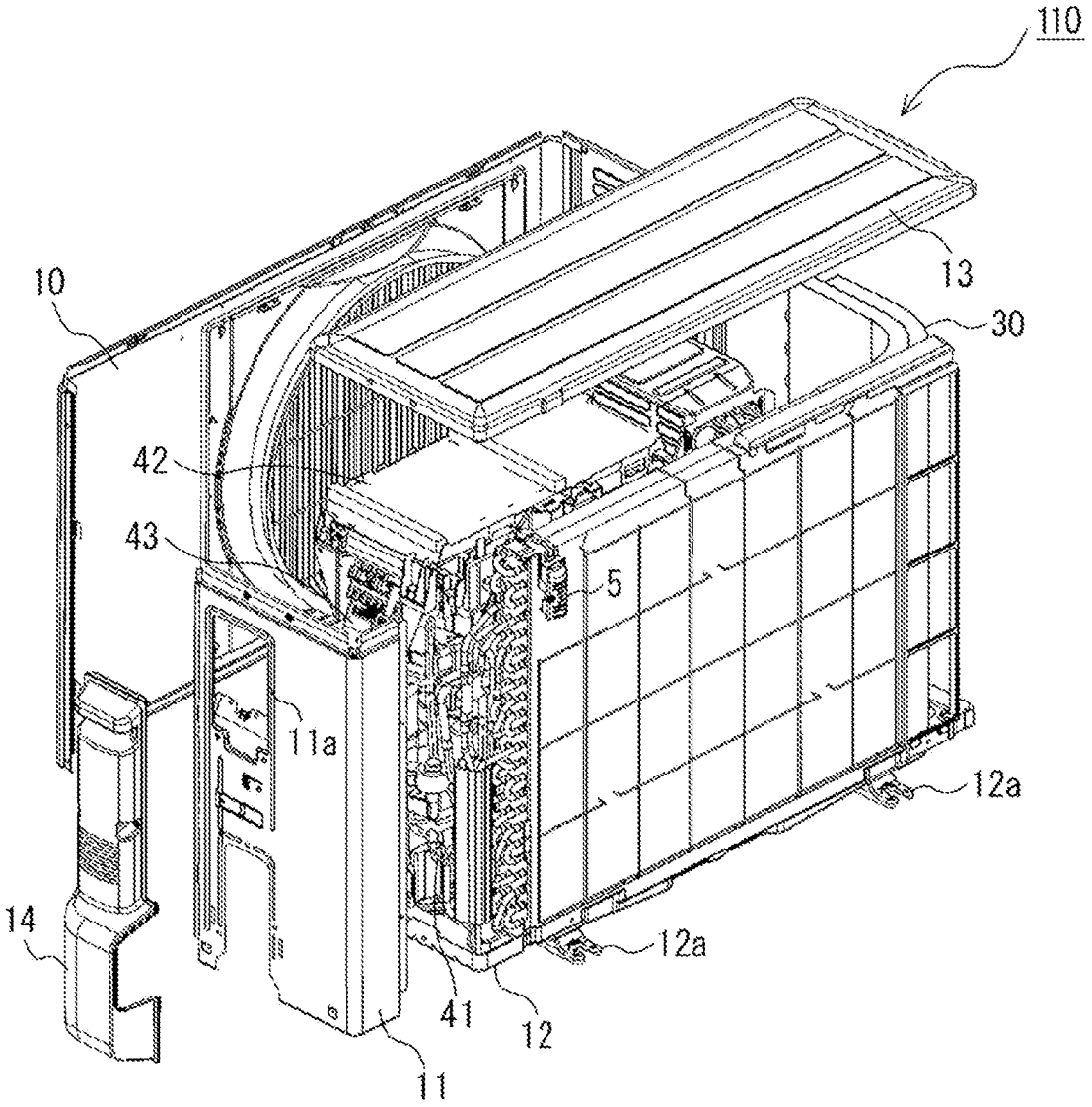
FIG. 4 is an exploded perspective view illustrating the outdoor unit of an air-conditioning apparatus and the outdoor unit is viewed from the rear.

First, a common structure of the outdoor unit 100 of an air-conditioning apparatus according to the present embodiment will be described with reference to the outdoor unit 110 of an air-conditioning apparatus that is illustrated in FIG. 1 to FIG. 10 and that includes the heat exchanger having a two-row structure. FIG. 1 is a perspective view illustrating an outdoor unit of an air-conditioning apparatus and the outdoor unit is viewed from the front. FIG. 2 is an exploded perspective view illustrating the outdoor unit of an air-conditioning apparatus and the outdoor unit is viewed from the front. FIG. 3 is a perspective view illustrating the outdoor unit of an air-conditioning apparatus and the outdoor unit is viewed from the rear. FIG. 4 is an exploded perspective view illustrating the outdoor unit of an air-conditioning apparatus and the outdoor unit is viewed from the rear.

The outdoor unit 110 of an air-conditioning apparatus illustrated in FIG. 1 to FIG. 4 includes a housing 1 that forms the outline of the outdoor unit 110. As an example, the housing 1 includes a front-side-surface panel 10, a right-side-surface panel 11, a bottom-surface panel 12, and a top-surface panel 13. The front-side-surface panel 10 is, for example, a part that has an L shape and forms the front side surface and the left side surface of the housing 1. The front-side-surface panel 10 has an air outlet that has a circular shape, and a fan guard 10*a* is attached to the front-side-surface panel 10 in such a manner as to cover the air outlet. The outdoor unit 110 of an air-conditioning apparatus has a structure in which leg portions 12*a* that are attached to the lower surface of the bottom-surface panel 12 are to be fixed at a location, so that the outdoor unit 110 is stably installed at the location.

Figure 5:
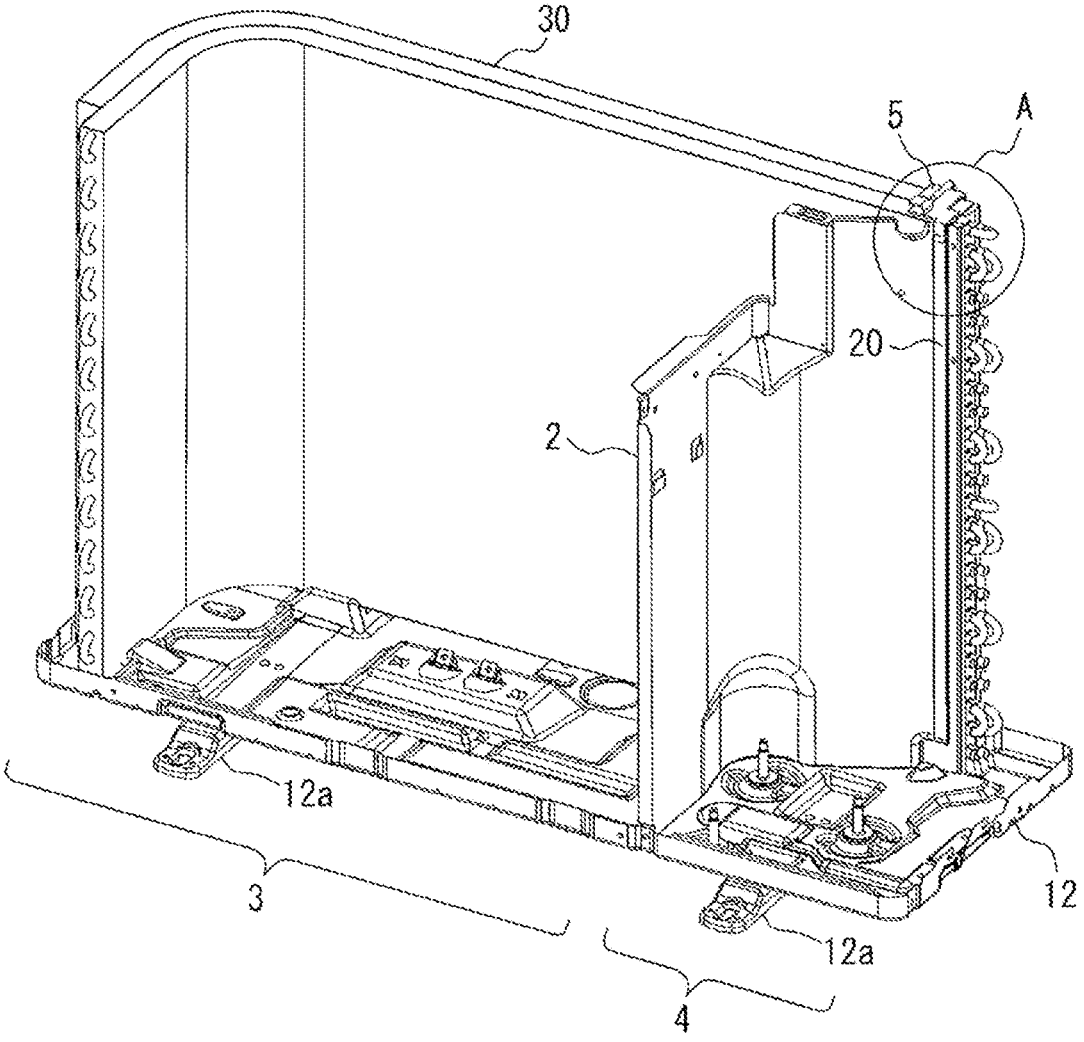
FIG. 5 is a perspective view illustrating an internal structure of the outdoor unit with no components illustrated other than a heat exchanger.
Figure 6:
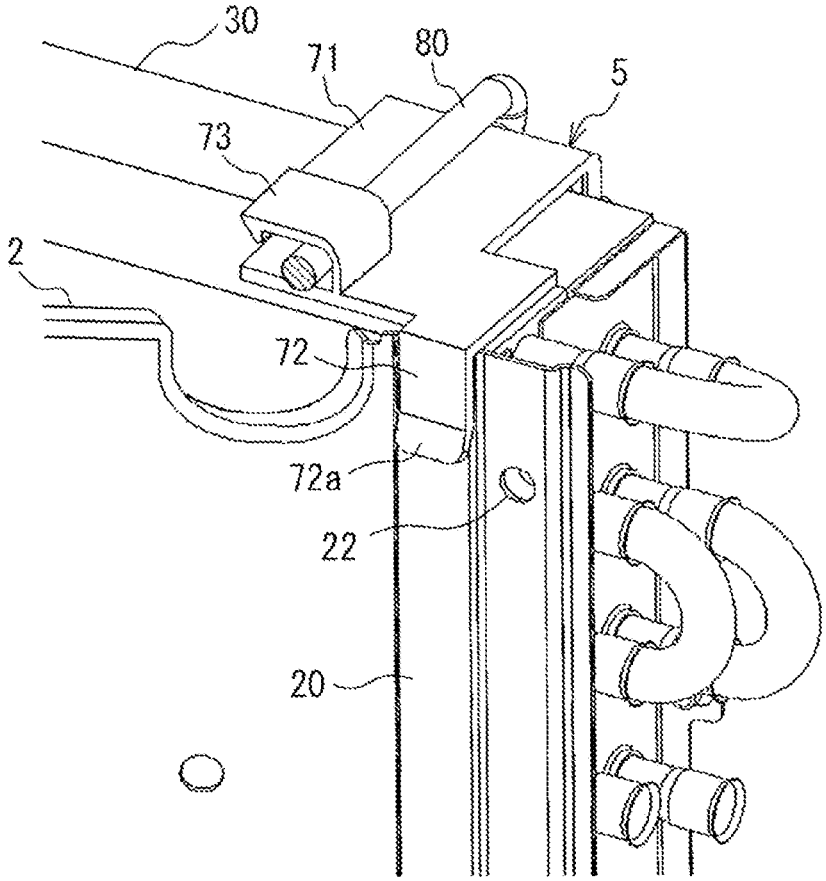
FIG. 6 is an enlarged view of the portion A illustrated in FIG. 5.
Figure 7:
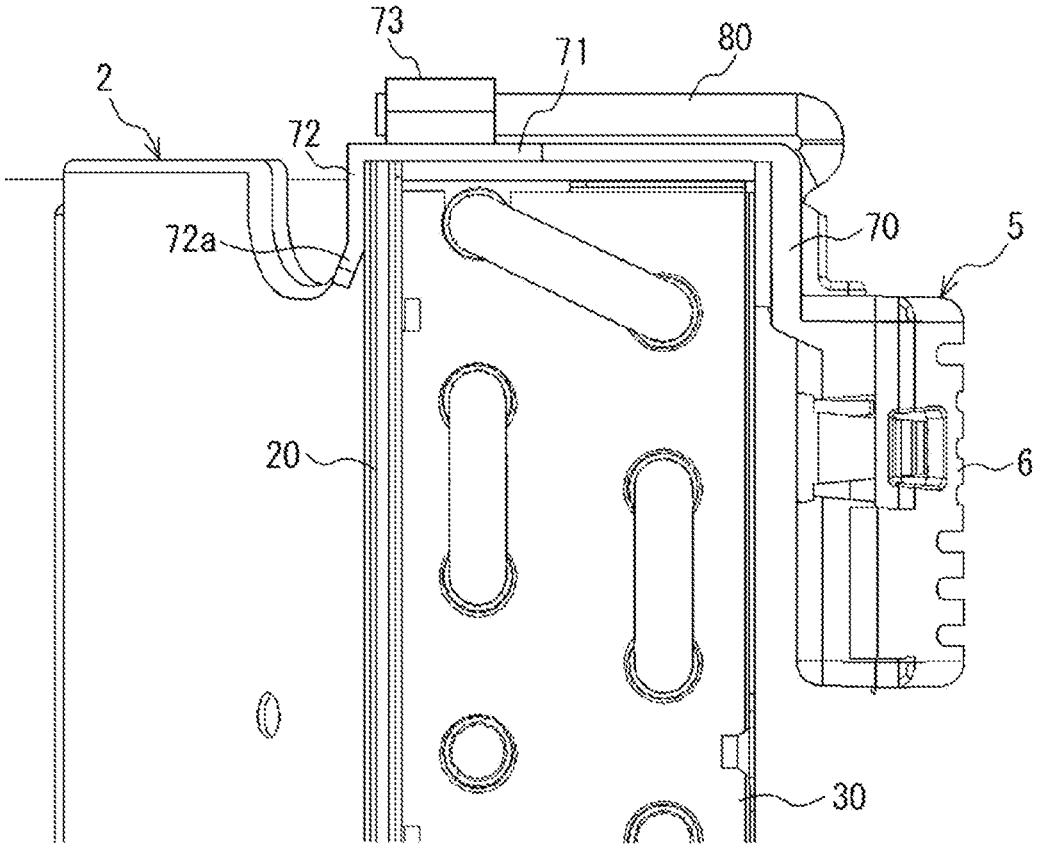
FIG. 7 is an enlarged view of the portion A illustrated in FIG. 5 and the portion A is viewed in a transverse direction.
Figure 8:
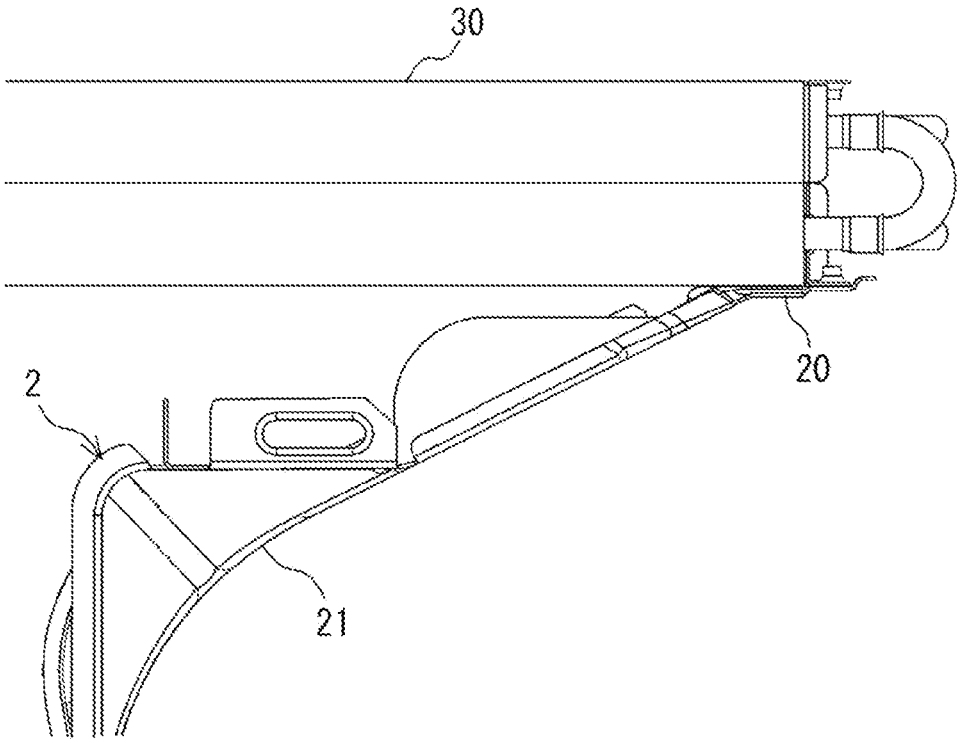
FIG. 8 is an enlarged view of the portion A and the peripheral portion illustrated in FIG. 5 and the portion A and the peripheral portion are viewed in plan.

FIG. 5 is a perspective view illustrating an internal structure of the outdoor unit with no components illustrated other than a heat exchanger. FIG. 6 is an enlarged view of the portion A illustrated in FIG. 5. FIG. 7 is an enlarged view of the portion A illustrated in FIG. 5 and the portion A is viewed in the transverse direction. FIG. 8 is an enlarged view of the portion A and the peripheral portion illustrated in FIG. 5 and the portion A and the peripheral portion are viewed in plan. Note that a holder 5 that is illustrated in FIG. 5 is not illustrated in FIG. 8. As illustrated in FIG. 5, the interior of the housing 1 is partitioned into an air-sending device chamber 3 and a machine chamber 4 by a partition plate 2 that extends from the front surface toward the rear surface.

As illustrated in FIG. 5, the partition plate 2 is curved toward the right side surface at a position partway along the partition plate 2 from the front surface toward the rear surface, and as illustrated in FIG. 6 to FIG. 8, a flat portion 20 that extends along a side surface of a heat exchanger 30 is formed at a terminal portion of a curved surface 21. The flat portion 20 has a flat surface that is in contact with the front side surface of the heat exchanger 30 and is joined to the heat exchanger 30 by screwing a shaft portion of a fastening part, such as a screw, into a through hole 22 that is provided in an end portion of the flat portion 20. The partition plate 2 is formed to have a shape that corresponds to the width dimension of the heat exchanger 30, and the shape of the partition plate 2 differs for each of various outdoor units.

As illustrated in FIG. 2, the heat exchanger 30, a propeller fan 32, a motor 33, and a motor mounting table 34 are disposed in the air-sending device chamber 3. The motor mounting table 34 is a part that holds the motor 33 to which the propeller fan 32 is attached, and the motor mounting table 34 is disposed in front of the heat exchanger 30. The outdoor unit 110 is configured in such a manner that, as the propeller fan 32 operates, air that has passed through the heat exchanger 30 is introduced into the outdoor unit 110, passes through the propeller fan 32, and is discharged to the front of the outdoor unit 110. As a result, in the outdoor unit 110, for example, during the period when an air-cooling operation is performed, refrigerant is cooled by the air in the heat exchanger 30, and the air that has passed through the heat exchanger 30 is heated by heat exchange with the refrigerant.

As illustrated in FIG. 2, FIG. 4, and FIG. 5, the heat exchanger 30 has a two-row structure and extends from an end portion located at the rear surface of the housing 1 to an end portion located at the left side surface of the housing 1. As an example, the width dimension of the heat exchanger 30, which has a two-row structure, is about 44 mm. As illustrated in FIG. 3, FIG. 4, FIG. 6, and FIG. 7, a holder 5 that is made of a synthetic resin and that accommodates a temperature-measurement unit 8 configured to measure the temperature of air outside the housing 1 is mounted on an upper left portion of the rear surface of the heat exchanger 30. The temperature-measurement unit 8 includes, for example, a thermistor.

As illustrated in FIG. 2 and FIG. 4, a compressor 40, a refrigerant pipe 41, an electrical-component unit 42, and a power-supply unit 43 are disposed in the machine chamber 4. The compressor 40 is placed on the upper surface of the bottom-surface panel 12 and compresses refrigerant sent from an indoor unit. The refrigerant compressed by the compressor 40 is sent to the heat exchanger 30 through the refrigerant pipe 41. The electrical-component unit 42 includes a control board and other components and is used for, for example, supplying power to each of the components arranged in the outdoor unit 110. The power-supply unit 43 has a configuration in which a terminal block that connects the outdoor unit 110 and the indoor unit to each other is fixed to a power board by using, for example, screws. As illustrated in FIG. 2 and FIG. 4, the power-supply unit 43 communicates with the outside through an opening 11*a* that is provided in the right-side-surface panel 11, and as illustrated in FIG. 1, the power-supply unit 43 is covered with a protective cover 14 that is attached to the outer surface of the right-side-surface panel 11 so that the power-supply unit 43 is protected against dust or water.

Figure 9:
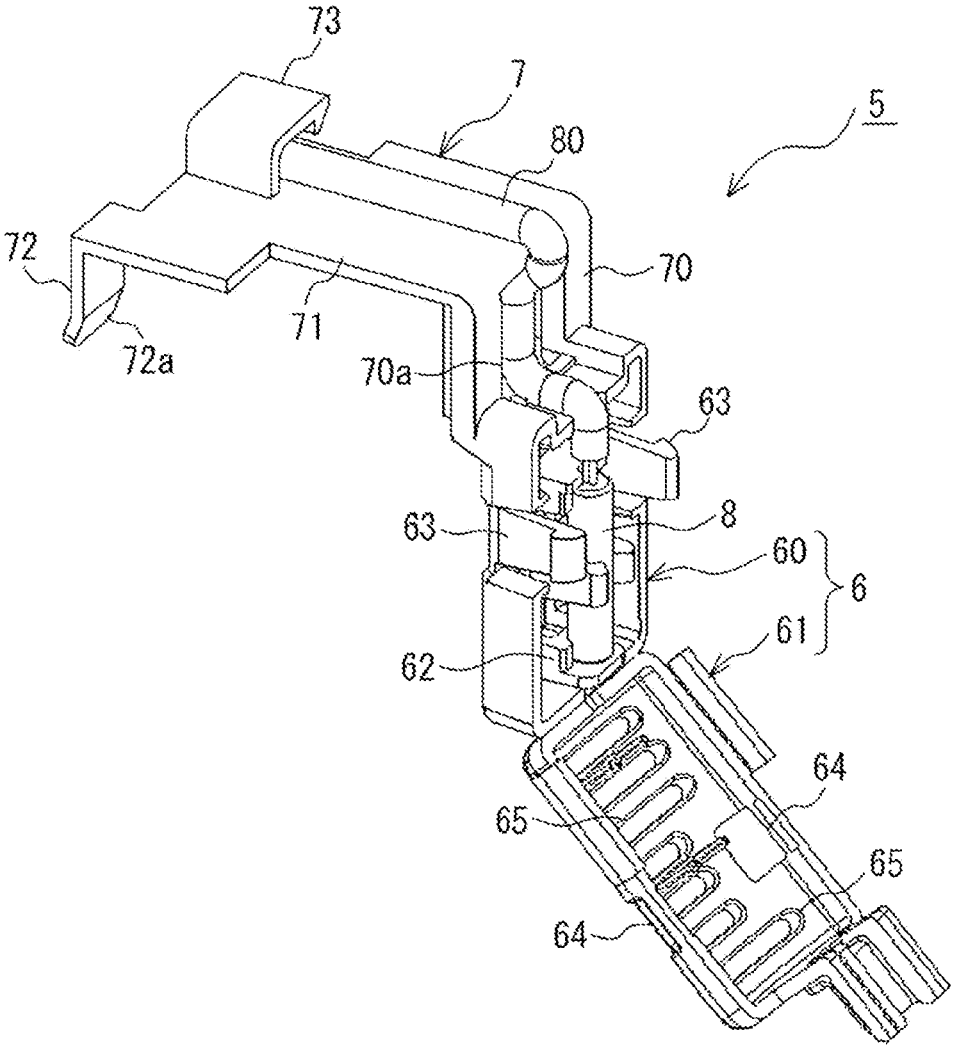
FIG. 9 is a perspective view illustrating a holder of the outdoor unit of an air-conditioning apparatus in a state where a cover portion is opened.
Figure 10:
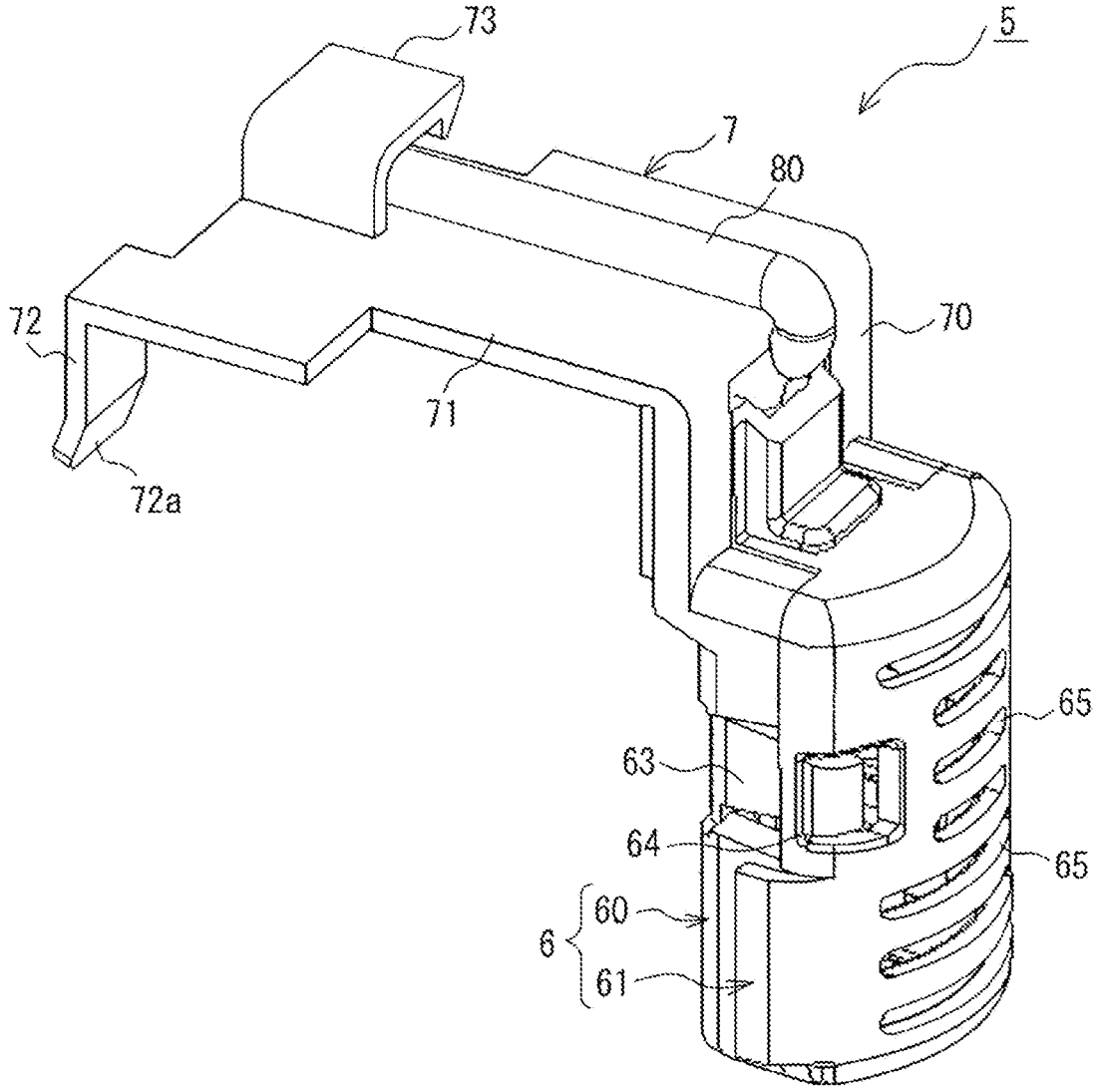
FIG. 10 is a perspective view illustrating the holder of the outdoor unit of an air-conditioning apparatus in a state where the cover portion is closed.

Next, the specific configuration of the holder 5 will be described with reference to FIG. 9 and FIG. 10. FIG. 9 is a perspective view illustrating a holder of the outdoor unit of an air-conditioning apparatus in a state where a cover portion is opened. FIG. 10 is a perspective view illustrating the holder of the outdoor unit of an air-conditioning apparatus in a state where the cover portion is closed. As illustrated in FIG. 9 and FIG. 10, the holder 5 includes an accommodating unit 6 that accommodates the temperature-measurement unit 8, and a hook unit 7 that is formed continuous with the accommodating unit 6 and that extends across the top surface of the heat exchanger 30 and is hooked to the flat portion 20.

The accommodating unit 6 includes a main-body portion 60 that is formed in a recessed manner and that has a base 62 to which the temperature-measurement unit 8 is attached and a cover portion 61 that is pivotally hinged to the lower end of the main-body portion 60. A hook 63 is formed on each of the two side edges of the main-body portion 60 and projects toward the cover portion 61. In contrast, a latch hole 64 is provided in each of the two side edges of the cover portion 61 in such a manner that the hooks 63 are latched into the latch holes 64. As illustrated in FIG. 10, the temperature-measurement unit 8 can be accommodated in the accommodating unit 6 by pivoting the cover portion 61 and latching the hooks 63 into the latch holes 64. In other words, an operation of attaching or detaching the temperature-measurement unit 8 can be performed by unlatching the hooks 63 from the latch holes 64 and pivoting the cover portion 61 to open the main-body portion 60 while the holder 5 is kept mounted on the heat exchanger 30. Note that a through hole is provided in the top surface of the accommodating unit 6 in such a manner that a lead wire 80 of the temperature-measurement unit 8, which is accommodated in the accommodating unit 6, passes through the through hole to the outside.

A plurality of slit-shaped ventilation holes (not illustrated) that are vertically long or horizontally long are provided in the main-body portion 60. In addition, a plurality of slit-shaped ventilation holes 65 that are horizontally long are provided in the cover portion 61. Wind that enters from the ventilation holes 65 of the cover portion 61 passes through the interior of the accommodating unit 6 and is suctioned into the heat exchanger 30 through the ventilation holes of the main-body portion 60.

The hook unit 7 includes an extended-surface portion 70 that extends from the accommodating unit 6 and that is in contact with the rear surface of the heat exchanger 30, a top-surface portion 71 that extends and is bent from an end portion of the extended-surface portion 70 and is placed on the top surface of the heat exchanger 30, and a hook portion 72 that extends and is bent from an end portion of the top-surface portion 71 and is hooked to the flat portion 20. The top-surface portion 71 has a length that is approximately the same as the width dimension of the heat exchanger 30 having a two-row structure.

A recess 70*a* is formed in the extended-surface portion 70, and the lead wire 80 of the temperature-measurement unit 8 that is protected by a protective tube is fitted into the recess 70*a* and is fixed in place. An L-shaped guide piece 73 that holds the lead wire 80 of the temperature-measurement unit 8 is provided on the top surface of the top-surface portion 71.

The hook portion 72 has an end portion 72*a* that is inclined outward. This configuration causes the end portion 72*a* of the hook portion 72 to be used as a guide portion when the holder 5 is mounted onto the heat exchanger 30.

As illustrated in FIG. 6 and FIG. 7, the holder 5 is mounted on the heat exchanger 30, which has a two-row structure, in such a manner that the hook unit 7 extends across the top surface of the heat exchanger 30 and is hooked onto the flat portion 20. In other words, the holder 5 is assembled in such a manner that the rear surface of the heat exchanger 30 and the flat portion 20 are sandwiched by the extended-surface portion 70 and the hook portion 72 and is positioned in such a manner that the top-surface portion 71 is in contact with the upper end edge of the flat portion 20 and the top surface of the heat exchanger 30. In this case, the end portion 72*a* of the hook portion 72 is used as the guide portion that guides the holder 5 toward the flat portion 20 when the holder 5 is mounted onto the heat exchanger 30.

Note that, in the embodiment illustrated in the drawings, although a configuration has been described in which the holder 5 is mounted onto the heat exchanger 30 by hooking the hook portion 72 onto the flat portion 20 of the partition plate 2, the configuration is not limited to this description. The holder 5 may be mounted onto the heat exchanger 30 by hooking the hook portion 72 onto the front side surface of the heat exchanger 30.

Figure 11:
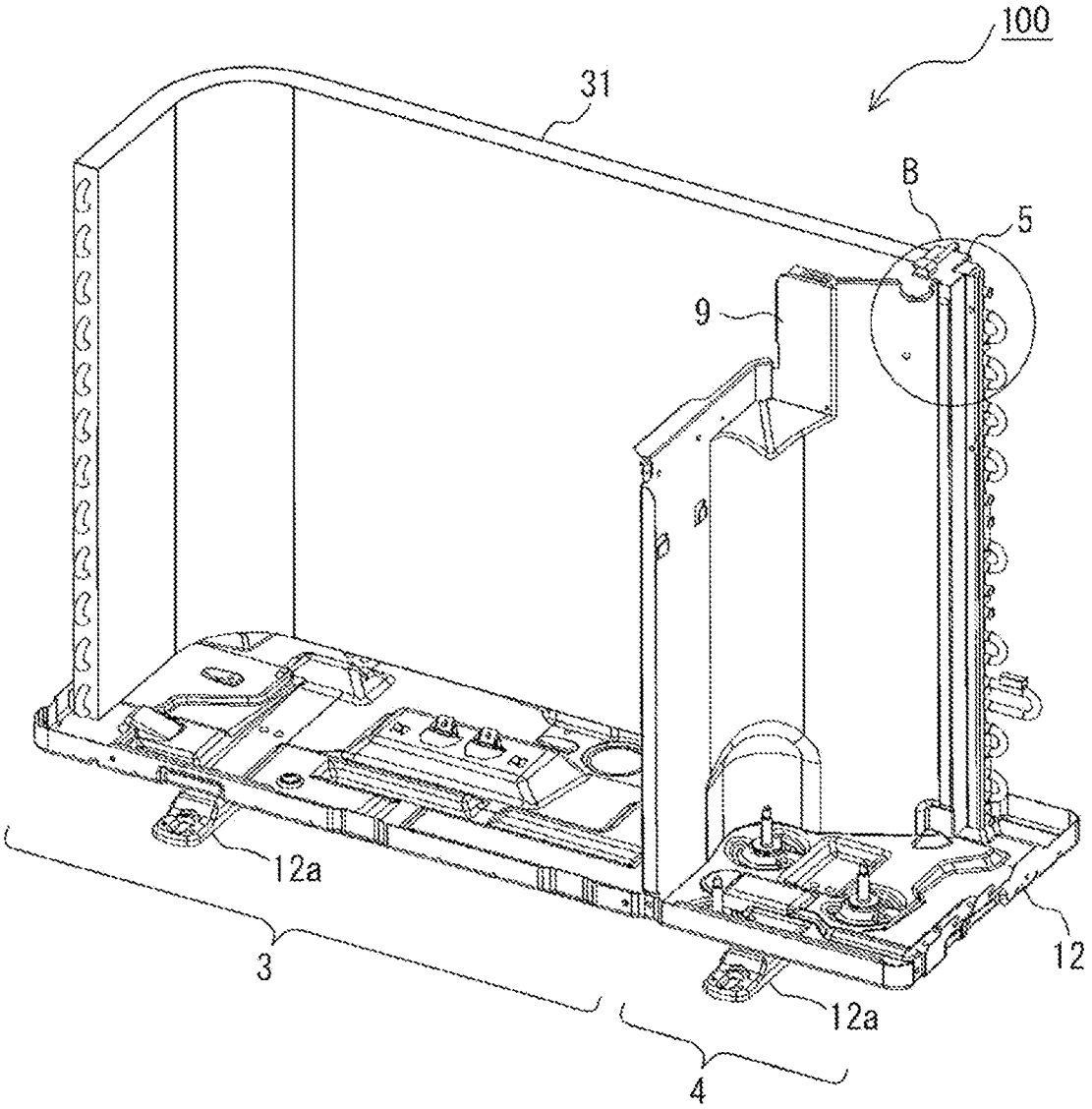
FIG. 11 is a perspective view illustrating an internal structure of the outdoor unit of an air-conditioning apparatus according to the present embodiment with no components illustrated other than the heat exchanger.
Figure 12:
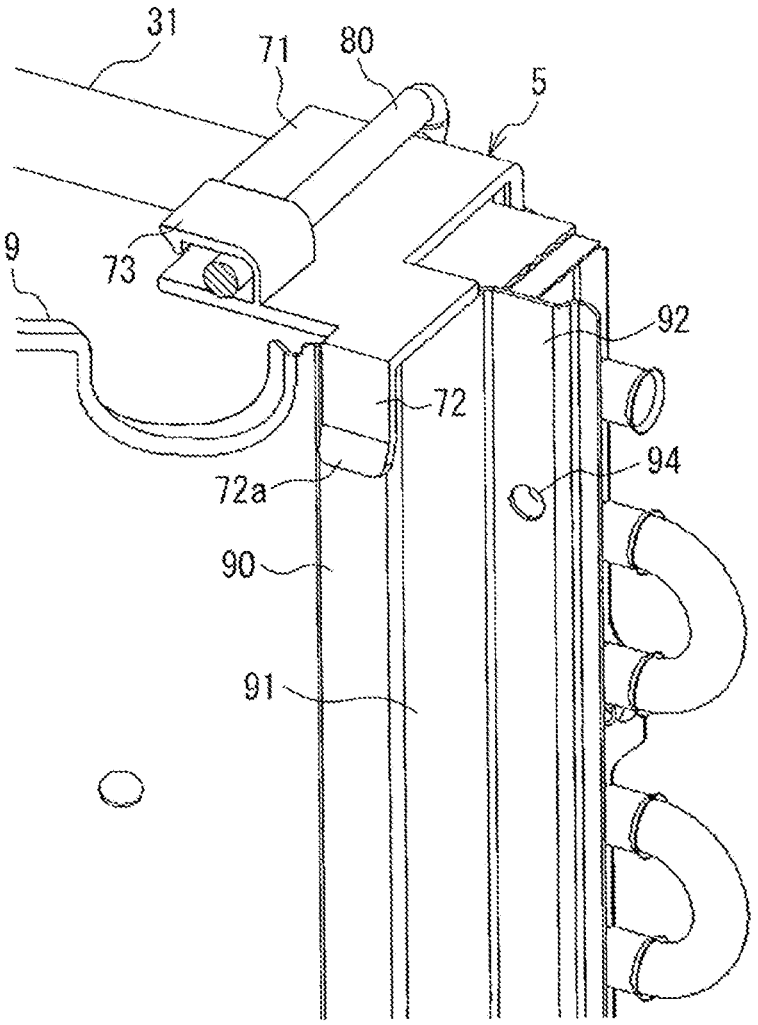
FIG. 12 is an enlarged view of the portion B illustrated in FIG. 11.
Figure 13:
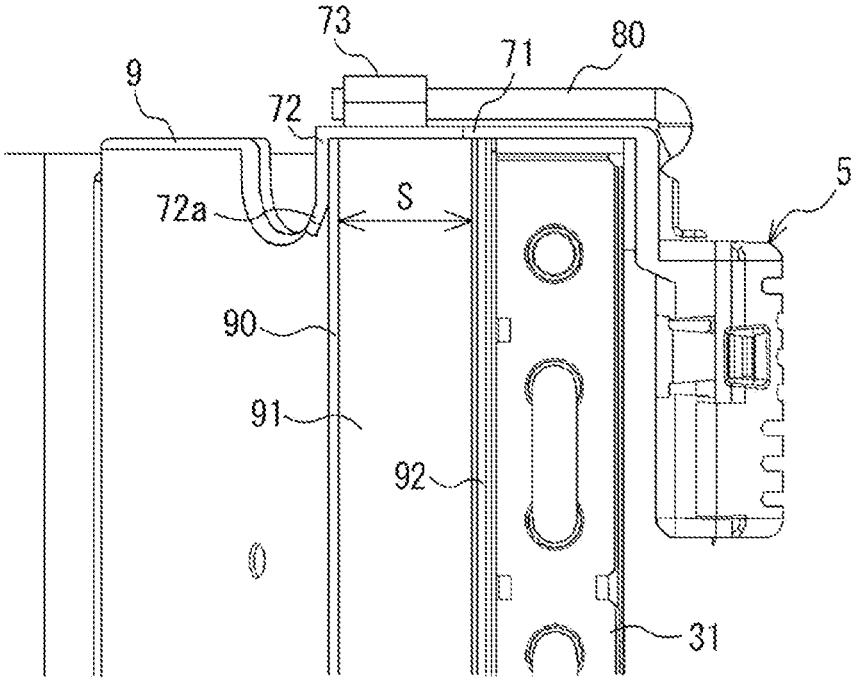
FIG. 13 is an enlarged view of the portion B illustrated in FIG. 11 and the portion B is viewed in the transverse direction.
Figure 14:
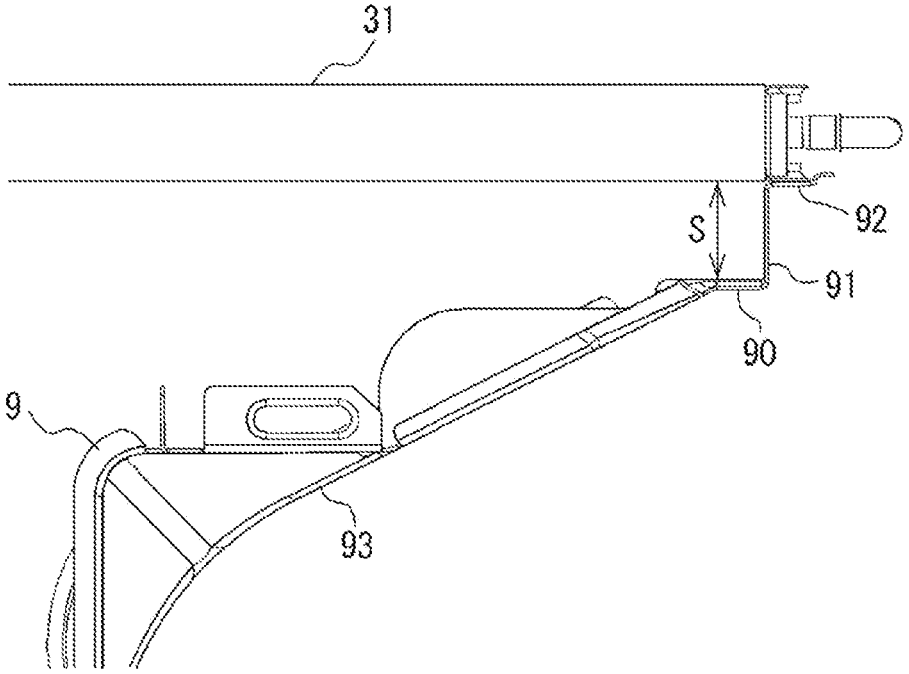
FIG. 14 is an enlarged view of the portion B and the peripheral portion illustrated in FIG. 11 and the portion B and the peripheral portion are viewed in plan.

Next, the outdoor unit 100 of an air-conditioning apparatus that includes a heat exchanger 31 that has a single-row structure will be described with reference to FIG. 11 to FIG. 14. FIG. 11 is a perspective view illustrating an internal structure of an outdoor unit of an air-conditioning apparatus according to the present embodiment with no components illustrated other than a heat exchanger. FIG. 12 is an enlarged view of the portion B illustrated in FIG. 11. FIG. 13 is an enlarged view of the portion B illustrated in FIG. 11 and the portion B is viewed in the transverse direction. FIG. 14 is an enlarged view of the portion B and the peripheral portion illustrated in FIG. 11 and the portion B and the peripheral portion are viewed in plan.

As illustrated in FIG. 11 to FIG. 13, in the outdoor unit 100 of an air-conditioning apparatus, the heat exchanger 31 having a single-row structure extends from the end portion located at the rear surface of the housing 1 to the end portion located at the left side surface of the housing 1. As an example, the width dimension of the heat exchanger 31, which has a single-row structure, is about 22 mm.

As illustrated in FIG. 11 and FIG. 14, a partition plate 9 that is used in the outdoor unit 100 of an air-conditioning apparatus includes a curved surface 93 that is curved toward the right side surface at a position partway along the partition plate 9 from the front surface toward the rear surface. The partition plate 9 includes a first flat portion 90 that is formed at a terminal portion of the curved surface 93 with a space S provided between the first flat portion 90 and the heat exchanger 31 and that extends in the longitudinal direction of the heat exchanger 31, and a second flat portion 91 that projects from a side edge portion of the first flat portion 90 toward the heat exchanger 31. The partition plate 9 may be formed through adjusting the size of the second flat portion 91, so that the space S having a desired size can be provided between the first flat portion 90 and the heat exchanger 31. In other words, in the present embodiment, as the space S that corresponds to the width dimension of the heat exchanger having a single-row structure can be provided by the second flat portion 91, the holder 5 that is the same as the holder 5 used for the outdoor unit 110 of an air-conditioning apparatus, which includes the heat exchanger 30 having a two-row structure, can be used for the outdoor unit 100 of an air-conditioning apparatus, which includes the heat exchanger 31 having a single-row structure.

In addition, as illustrated in FIG. 12 and FIG. 14, the partition plate 9 includes a third flat portion 92 that projects from a side edge portion of the second flat portion 91 in the longitudinal direction of the heat exchanger 31. The third flat portion 92 is in contact with the front side surface of the heat exchanger 31 and is joined to the heat exchanger 31 by screwing a shaft portion of a fastening part, such as a screw, into a through hole 94. Note that the partition plate 9 may have a different configuration with which the partition plate 9 is joined to the heat exchanger 31 without the third flat portion 92.

As illustrated in FIG. 12 and FIG. 13, the holder 5 is mounted on the rear surface of the heat exchanger 31, which has a single-row structure, in such a manner that the hook unit 7 extends across the top surface of the heat exchanger 31 and is hooked onto the first flat portion 90. More specifically, the holder 5 is assembled in such a manner that the rear surface of the heat exchanger 31 and the first flat portion 90 are sandwiched by the extended-surface portion 70 and the hook portion 72 and is positioned in such a manner that the top-surface portion 71 is in contact with the upper end edge of the first flat portion 90 and the top surface of the heat exchanger 31. Note that the end portion 72*a* of the hook portion 72 is used as a guide portion when the holder 5 is mounted onto the heat exchanger 31.

Note that, in the embodiment illustrated in the drawings, although a case has been described as an example in which the holder 5 that is the same as the holder 5 used for the outdoor unit 110 of an air-conditioning apparatus, which includes the heat exchanger 30 having a two-row structure, can be used for the outdoor unit 100 of an air-conditioning apparatus, which includes the heat exchanger 31 having a single-row structure, the configuration is not limited to this case. In the outdoor unit 100 of an air-conditioning apparatus according to the present embodiment, the partition plate 9 may be formed through adjusting the length of the second flat portion 91, so that a holder that is the same as a holder used for one outdoor unit of an air-conditioning apparatus that includes a heat exchanger having a three-row structure can also be used for another outdoor unit of an air-conditioning apparatus that includes a heat exchanger having a single-row structure. In addition, a holder that is the same as a holder used for one outdoor unit of an air-conditioning apparatus that includes a heat exchanger having a single-row structure can be used for another outdoor unit of an air-conditioning apparatus that includes a heat exchanger having a single-row structure and having a width dimension different from that of the heat exchanger included in the one outdoor unit.

As described above, with the outdoor unit 100 of an air-conditioning apparatus of the present embodiment, the housing 1 that forms the outline of the outdoor unit 100, the partition plate 9 that extends from the front surface toward the rear surface of the housing 1 and that partitions the interior of the housing 1 into the air-sending device chamber 3 and the machine chamber 4, the heat exchanger 31 that is disposed in the air-sending device chamber 3 and along the end portion located at the rear surface of the housing 1, and the holder 5 that is mounted on the heat exchanger 31 and that accommodates the temperature-measurement unit 8 configured to measure the outside air temperature. The partition plate 9 includes the first flat portion 90 that is disposed with the space S provided between the rear surface of the first flat portion 90 and the heat exchanger 31 and that extends in the longitudinal direction of the heat exchanger 31, and the second flat portion 91 that projects from the side edge portion of the first flat portion 90 toward the heat exchanger 31. The holder 5 includes the accommodating unit 6 that accommodates the temperature-measurement unit 8, and the hook unit 7 that is formed continuous with the accommodating unit 6 and that extends across the top surface of the heat exchanger 31 and is hooked to the first flat portion 90.

Consequently, the partition plate 9 may be formed through adjusting the length of the second flat portion 91, so that the space S between the first flat portion 90 and the heat exchanger 31 can fit the shape of the holder 5, and thus, the outdoor unit 100 of an air-conditioning apparatus according to the present embodiment can use the holder 5 that is the same as the holder 5 used for the outdoor unit 110, which includes the heat exchanger 30 having a width dimension different from the width dimension of the heat exchanger 31. With the outdoor unit 100 of an air-conditioning apparatus according to the present embodiment, when the holders 5 are manufactured, only a few manufacturing molds therefore need to be prepared for the shapes of the holders 5, and the manufacturing costs can be kept low. In addition, the burden of managing different types of the holders 5 by classifying the holders 5 by their types can be reduced.

The partition plate 9 further includes the third flat portion 92 that projects from the side edge portion of the second flat portion 91 in the longitudinal direction of the heat exchanger 31. Thus, in the outdoor unit 100 of an air-conditioning apparatus according to the present embodiment, the partition plate 9 can be fixed in place by bringing the third flat portion 92 into contact with the heat exchanger 31 and joining the third flat portion 92 and the heat exchanger 31 to each other by using a fastening part, such as a screw.

The hook unit 7 of the holder 5 includes the extended-surface portion 70 that extends from the accommodating unit 6 and that is in contact with the rear surface of the heat exchanger 31, the top-surface portion 71 that extends and is bent from the end portion of the extended-surface portion 70 and is placed on the top surface of the heat exchanger 31, and the hook portion 72 that extends and is bent from the end portion of the top-surface portion 71 and hooked to the first flat portion 90. The hook portion 72 has the end portion 72*a*, which is inclined outward. Thus, in the outdoor unit 100 of an air-conditioning apparatus according to the present embodiment, the end portion 72*a* of the hook portion 72 is used as a guide portion that guides the holder 5 toward the first flat portion 90 when the holder 5 is mounted onto the heat exchanger 31, and this configuration facilitates an operation of mounting the holder 5, so that the operational efficiency can be improved.

Although the present invention has been described above with reference to the embodiment, the present invention is not limited to the configuration according to the above-described embodiment. For example, each of the configurations of the outdoor units of air-conditioning apparatuses that are illustrated in the drawings is an example, and the configuration is not limited to the above-described contents. The configuration can be applied to an outdoor unit of an air-conditioning apparatus that includes other components. In other words, it should be noted that various modifications, applications, and usages that are made as necessary by those skilled in the art are also included in the gist (technical scope) of the present invention.

REFERENCE SIGNS LIST

1 housing 2 partition plate 3 air-sending device chamber 4 machine chamber 5 holder 6 accommodating unit 7 hook unit 8 temperature-measurement unit 9 partition plate 10 front-side-surface panel 10*a* fan guard 11 right-side-surface panel 11*a* opening 12 bottom-surface panel 12*a* leg portion 13 top-surface panel 14 protective cover 20 flat portion 21 curved surface 22 through hole 30, 31 heat exchanger 32 propeller fan 33 motor 34 motor mounting table 40 compressor 41 refrigerant pipe 42 electrical-component unit 43 power-supply unit 60 main-body portion 61 cover portion 62 base 63 hook 64 latch hole 65 ventilation hole 70 extended-surface portion 70*a* recess 71 top-surface portion 72 hook portion 72*a* end portion 73 guide piece 80 lead wire 90 first flat portion 91 second flat portion 92 third flat portion 93 curved surface 94 through hole 100, 110 outdoor unit of air-conditioning apparatus

The invention claimed is:

1. An outdoor unit of an air-conditioning apparatus, the outdoor unit comprising:

a housing forming an outline of the outdoor unit;

a partition plate extending from a front surface of the housing toward a rear surface of the housing and partitioning an interior of the housing into an air-sending device chamber and a machine chamber;

a heat exchanger disposed in the air-sending device chamber and along an end portion located at the rear surface of the housing; and a holder mounted on the heat exchanger and accommodating a temperature-measurement unit configured to measure an outside air temperature, the partition plate including a first flat portion disposed with a space between a rear surface of the first flat portion and the heat exchanger and extending in a longitudinal direction of the heat exchanger, and a second flat portion projecting from a side edge portion of the first flat portion toward the heat exchanger, the holder including an accommodating unit holding the temperature-measurement unit, and a hook unit formed continuous with the accommodating unit, the hook unit extending across a top surface of the heat exchanger and being hooked to the first flat portion.

2. The outdoor unit of an air-conditioning apparatus of claim 1, wherein the partition plate further includes a third flat portion projecting from a side edge portion of the second flat portion in the longitudinal direction of the heat exchanger.

3. The outdoor unit of an air-conditioning apparatus of claim 1, wherein the hook unit of the holder includes an extended-surface portion extending from the accommodating unit, the extended-surface portion being in contact with a rear surface of the heat exchanger, a top-surface portion extending and being bent from an end portion of the extended-surface portion and placed on the top surface of the heat exchanger, and a hook portion extending and being bent from an end portion of the top-surface portion and hooked to the first flat portion, and wherein the hook portion has an end portion that is inclined outward.

* * * * *